US006627310B2

(12) United States Patent
Lee et al.

(10) Patent No.: US 6,627,310 B2
(45) Date of Patent: Sep. 30, 2003

(54) POLY(TRIMETHYLENE TEREPHTHALATE) BCF CARPET YARN WITH NONCIRCULAR CROSS SECTION AND METHOD FOR PREPARING THE SAME

(75) Inventors: Kyool Seop Lee, Gunpo-shi (KR); Young Chan Choi, Seoul (KR); Jong Bok Lee, Anyang-shi (KR)

(73) Assignee: Hyosung Corporation, Seoul (KR)

( * ) Notice: Subject to any disclaimer, the term of this patent is extended or adjusted under 35 U.S.C. 154(b) by 0 days.

(21) Appl. No.: 10/077,506

(22) Filed: Feb. 15, 2002

(65) Prior Publication Data

US 2003/0064219 A1 Apr. 3, 2003

(30) Foreign Application Priority Data

May 14, 2001 (KR) ..... 2001-26146

(51) Int. Cl.[7] ..... D01F 6/00

(52) U.S. Cl. ..... 428/364; 428/92; 428/362; 428/397

(58) Field of Search ..... 428/364, 395, 428/397, 362, 92

(56) References Cited

U.S. PATENT DOCUMENTS 4,492,731 A * 1/1985 Bankar et al. ..... 428/362
5,662,980 A * 9/1997 Howell et al. ..... 428/88

* cited by examiner

*Primary Examiner*—N. Edwards
(74) *Attorney, Agent, or Firm*—Fish & Richardson P.C.

(57) ABSTRACT

Disclosed is a poly(trimethylene terephthalate) BCF carpet modified cross-section yarn having an modification ratio and a arm angle within a specific range and a Y-shaped cross-section, and a method for preparing it. The BCF modified cross-section yarn has excellent bulk property and spinning efficiency, and a carpet made from the BCF modified cross-section yarn has good appearance, sense of touch, and tufting efficiency.

2 Claims, 3 Drawing Sheets

【FIG 1】
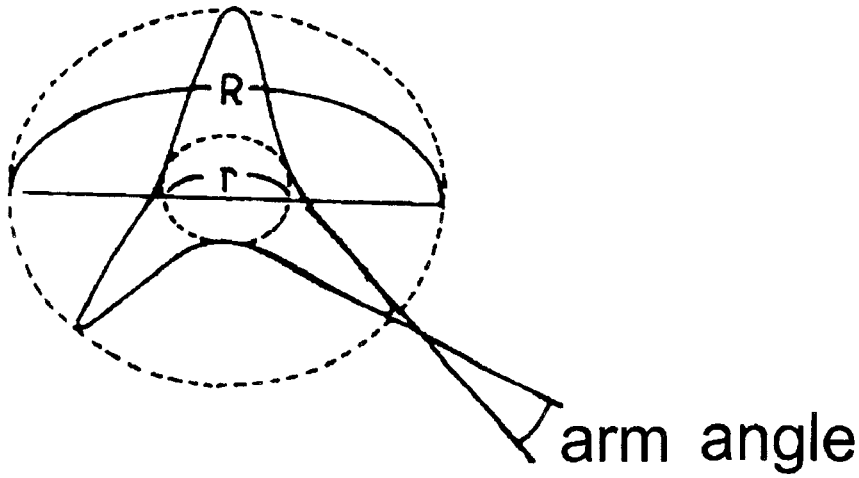
【FIG 2】
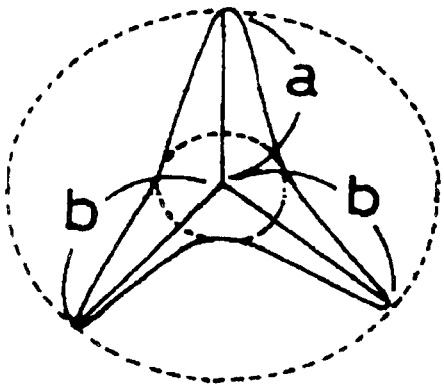

【FIG 3】
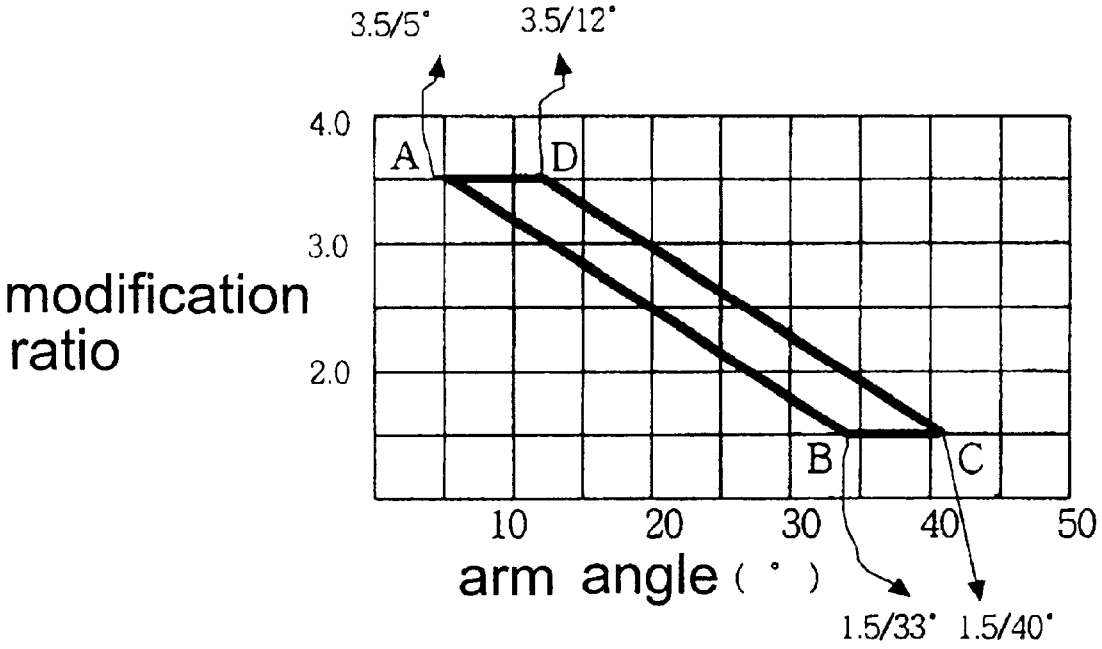

【FIG 4】
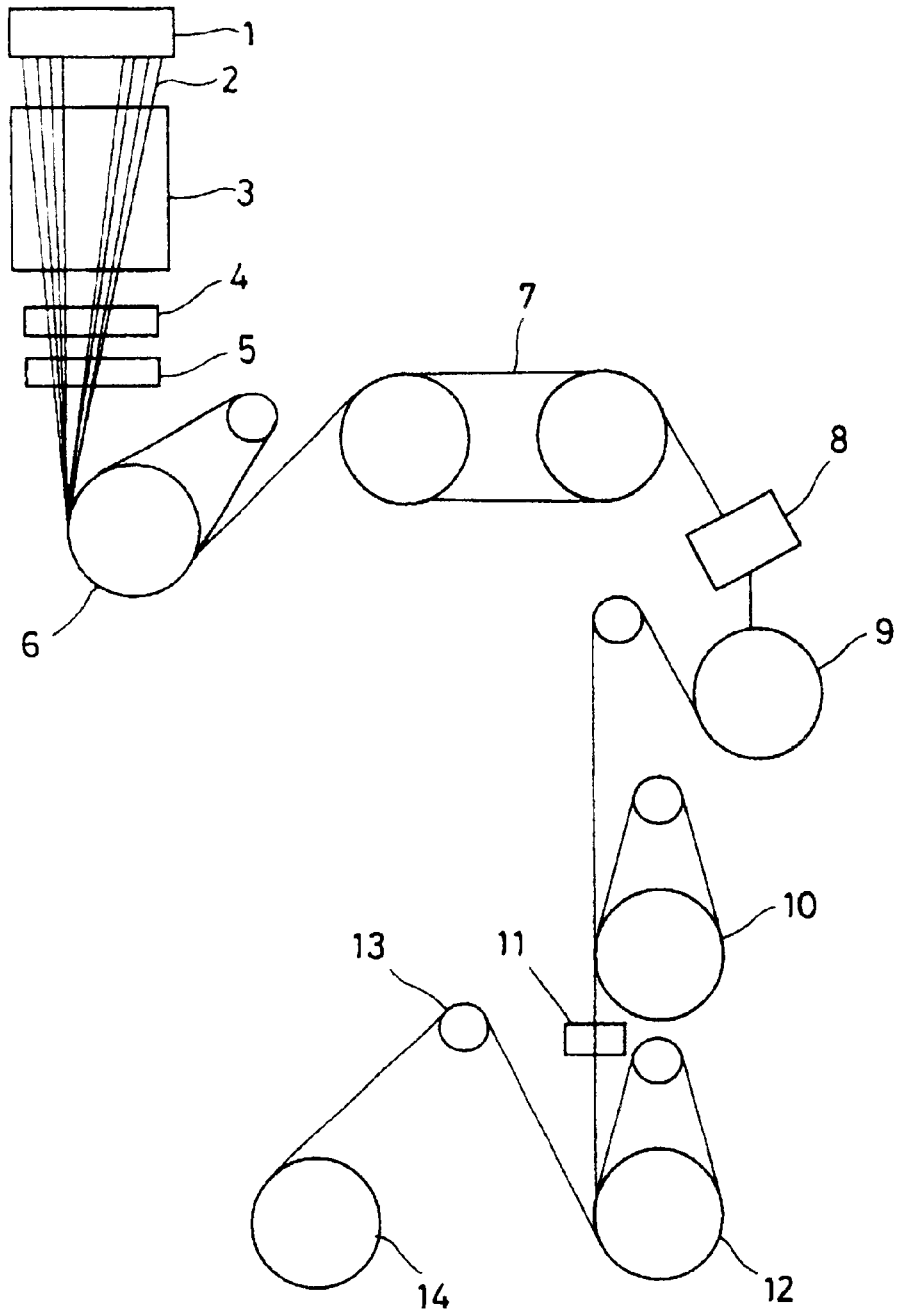

POLY(TRIMETHYLENE TEREPHTHALATE) BCF CARPET YARN WITH NONCIRCULAR CROSS SECTION AND METHOD FOR PREPARING THE SAME

BACKGROUND OF THE INVENTION

1. Field of the Invention

The present invention relates, in general, to a poly (trimethylene terephthalate) (PTT) BCF carpet modified cross-section yarn and a method for preparing the same and in particular, to a poly(trimethylene terephthalate) BCF carpet modified cross-section yarn and a method for preparing the same, in which a Y-shaped nozzle having a properly controlled modification ratio, an arm angle, and a length ratio of arms is used. The poly(trimethylene terephthalate) BCF carpet modified cross-section yarn according to the present invention has uniform physical properties, and excellent bulk property and spinning efficiency.

2. Description of the Prior Art

Generally, a synthetic fiber material of BCF (bulked continuous filament) for use in carpets is selected from the group consisting of nylon, polypropylene, and poly(ethylene terephthalate). To produce a carpet having excellent luster, a degree of cover, the sense of touch, and stain-resistance, filaments with various shapes of a cross section have been developed. Most of the filaments with non-circular cross sections which have been developed for application for carpets are made from polyamide, but the cross sectional non-circularity does not allow the application of poly (trimethylene terephthalate) for carpets owing to its very low tenacity.

For example, Korean Patent No. 25283 discloses a method for preparing polyamide modified cross-section yarn with a Y-shaped cross-section, in which non-circular cross-section yarns with an uniform cross sectional area can be produced during cooling by non-uniformly varying hole sizes of a spinneret relative to each other. However, with respect to moving velocity of yarns, an amount of cooling air, and a cooling temperature in a cooling zone, cross sectional areas of filaments are not substantially varied but filaments have non-uniform shape of cross sections, thereby a postprocess efficiency is lowered—capillaries are readily formed and cutting efficiency is reduced during the tufting.

Furthermore, Korean Patent No. 27228 discloses carpet synthetic filaments with a triangular cross-section, in which a ratio of an arm angle to a modification ratio is too large, and so a synthetic filament has a triangular cross-section. Therefore, the synthetic filaments have a low bulk property because the modification ratio is low. Also, a polyamide modified cross-section yarn with a Y-shaped cross section has excellent bulk property within a range of high modification ratio, but poly(trimethylene terephthalate) with a low tenacity and a Y-shaped cross section can hardly endure a friction between a spinning guide and poly(trimethylene terephthalate), and so spinning efficiency is rapidly reduced. Accordingly, this invention is restricted to polyamide.

A carpet for home or office uses particularly requires stain-resistance. A carpet made from poly(trimethylene terephthalate) filaments has excellent resilience, stain-resistance, and dyeing property to disperse dyes. Also, the carpet has excellent elastic recovery and pile height retention in comparison with poly(ethylene terephthalate) or poly (butylene terephthalate). Therefore, poly(trimethylene terephthalate) has lately attracted considerable attention as new material for carpet production.

U.S. Pat. No. 5,662,980 discloses carpets made from poly(trimethylene terephthalate) bulked continuous filament modified cross-section yarn, in which poly(trimethylene terephthalate) BCF yarn used to make carpets has excellent stain-resistance, bending ability, and pile height retention. However, this invention has disadvantages in that elastic recovery of the carpet is lowered because bulk property of a grey yarn is reduced owing to a low modification ratio of 1.7, and dyeing property of the carpet having a structure of a cut pile is reduced, and also appearance of the carpet is poor because apparent specific gravity is low.

SUMMARY OF THE INVENTION

Therefore, it is an object of the present invention to avoid disadvantages of prior arts, and to provide a poly (trimethylene terephthalate) BCF carpet modified cross-section yarn and a method for preparing it, in which a Y-shaped nozzle having a properly controlled modification ratio, an arm angle, and a length ratio of arms is used. The poly(trimethylene terephthalate) BCF carpet modified cross-section yarn according to the present invention has uniform physical properties, and excellent bulk property and spinning efficiency.

It is another object of the present invention to provide a poly(trimethylene terephthalate) BCF carpet modified cross-section yarn having excellent tufting efficiency, appearance, the sense of touch, and luster, and a method for preparing it.

In order to accomplish the above objects, one aspect of the present invention provides a poly(trimethylene terephthalate) BCF carpet modified cross-section yarn with a Y-shaped cross-section, in which a modification ratio and an arm angle are within a range of a parallelogram ABCD in FIG. 3.

Another aspect of the present invention provides a method for preparing a poly(trimethylene terephthalate) BCF carpet modified cross-section yarn, in which yarns are spun through a nozzle designed in such a way that a modification ratio and an arm angle of the Y-shaped cross-section are within a range of a parallelogram ABCD in FIG. 3.

Still another aspect of the present invention provides a method for preparing a poly(trimethylene terephthalate) BCF carpet yarn of a modified cross-section, which shows a high bulk property and can overcome disadvantages of prior arts occurring particularly at high or low modification ratios by using a nozzle designed to have a proper length ratio of arms of a Y-shaped cross-section yarn.

BRIEF DESCRIPTION OF THE DRAWINGS

The above and other objects, features and other advantages of the present invention will be more clearly understood from the following detailed description taken in conjunction with the accompanying drawings, in which:

FIG. 1 illustrates a modification ratio and a arm angle of a poly(trimethylene terephthalate) BCF carpet modified cross-section yarn according to the present invention;

FIG. 2 illustrates a length ratio of arms of a poly (trimethylene terephthalate) BCF carpet modified cross-section yarn according to the present invention;

FIG. 3 is a graph illustrating a range of a modification ratio and a arm angle of a poly(trimethylene terephthalate) BCF carpet modified cross-section yarn according to the present invention;

FIG. 4 schematically illustrates a production of a poly (trimethylene terephthalate) BCF carpet modified cross-section yarn according to the present invention.

DETAILED DESCRIPTION OF THE INVENTION

Before the present invention is disclosed or described, the terminology used in this application is defined as follows:

With reference to FIG. 1, 'modification ratio' means a ratio of a diameter R of circumscribed circle to a diameter r of inscribed circle of one filament in grey yarns with a Y-shaped cross section, i.e. modification ratio=R/r, and 'arm angle' means an acute angle formed by two extended lines of both edges of one arm of a filament in grey yarns with a Y-shaped cross section.

Referring to FIG. 2, 'length ratio of arms' means a ratio of other one arm's length (a) to two arms' lengths (b) which are identical to each other, i.e. b:a. The length of arms is a distance from a center of a filament cross section to a terminal end of arms.

Poly(trimethylene terephthalate) BCF carpet modified cross-section yarns of the present invention have a Y-shaped cross-section, and a modification ratio and an arm angle of the Y-shaped cross-section are within a range of a parallelogram ABCD in FIG. 3.

When the modification ratio of poly(trimethylene terephthalate) BCF carpet modified cross-section yarns of the present invention is less than 1.5, BCF modified cross-section yarns have sufficient spinning efficiency, but insufficient bulk property. On the other hand, when the modification ratio is more than 3.5, strength and elongation of the grey yarn are rapidly reduced and yarn cutting frequently occurs, and so spinning operation cannot be normally conducted.

As for the arm angle, poly(trimethylene terephthalate) BCF carpet modified cross-section yarns of the present invention have an arm angle of 5 to 40°. For example, when the arm angle is less than 5° or more than 40°, bulk property and spinning efficiency are not sufficiently improved although the modification ratio and the length ratio of arms have preferable values.

When the modification ratio of conventional modified cross-section yarns is 1.8 or less, or 2.5 or more, spinning efficiency and quality of the modified cross-section yarns are poor. However, the present invention overcomes these disadvantages of the prior art by controlling the length ratio of arms of a filament. That is to say, the ratio of the length of the arm having a unique length a to the lengths of the other two arms having the same length b, i.e. b:a, of BCF modified cross-section yarns is controlled within a range of 1:0.6 to 1.8, so that bulk property and spinning efficiency are excellent. For example, when the length ratio of arms is less than 1:0.6, or more than 1:1.8, a spinning operation cannot be normally conducted and yarn cutting frequently occurs because a difference of arm lengths in a filament is too severe.

Now, a method for preparing poly(trimethylene terephthalate) BCF modified cross-section yarns of the present invention will be described in more detail with reference to the accompanying FIG. 4.

According to the present invention, a nozzle is designed in such a way that poly(trimethylene terephthalate) BCF modified cross-section yarns have a Y-shaped cross-section, and a modification ratio and an arm angle of the Y-shaped cross-section are within a range of a parallelogram ABCD in FIG. 3. In particular, a nozzle having a modification ratio of 1.5 to 3.5, an arm angle of 5 to 40°, and 40 holes or more is used.

Poly(trimethylene terephthalate) with an intrinsic viscosity of 0.8 to 1.2 and a moisture content of 50 ppm or less is used as raw materials, and preferably melt-spun at a spinning rate of 1500 to 4000 m/min. A cross-section shape of poly(trimethylene terephthalate) BCF modified cross-section yarns of the present invention is varied according to various factors such as a shape of a nozzle, an intrinsic viscosity of used polymer, and cooling conditions. Poly (trimethylene terephthalate) BCF modified cross-section yarns of the present invention may be produced by use of a general machine.

To produce poly(trimethylene terephthalate) BCF modified cross-section yarns of the present invention, in more detail, PTT polymer with an intrinsic viscosity of 0.8 to 1.2 and a moisture content of 50 ppm or less is melt-spun at 245 to 265° C. through a spinneret 1. A nozzle having a Y-shaped cross-section, and a modification ratio and an arm angle of the Y-shaped cross-section within a range of a parallelogram ABCD in FIG. 3 is used.

Then, spun filaments 2 were cooled in a cooling zone 3, oiled with a finish applicate 4, passed through a nozzle 5 for inhaling yarns which inhales snapped thread during the spinning, and drawn by use of a supplying roller 6 at a rate of 650 to 850 m/min and a drawing roller 7 at a rate of 1500 to 4000 m/min. Filaments were crimped through a bulking unit 8 with a texturing nozzle after filaments were passed through the drawing roller 7, and crimp is 10 to 60%.

After that, filaments are cooled through a cooling drum 9, and passed through a whirling machine 11 via a godet roller 10, and so knots of 10 to 45 times/m are endowed to filaments. When whirling of 10 times/m or less is endowed to filaments, problems of fluffiness or capillaries occurs because condensing ability of a grey yarn is reduced, and so cutting ability of the grey yarn is reduced during the tufting, thereby a sheared carpet has a bad appearance because the edges of pile are excessively frayed, and a bearing strength of the carpet is also lowered.

On the other hand, if filaments are whirled at 40 times/m or more, the carpet is poor in appearance because the filaments remain knotted even after dyeing and postprocessing. Thereafter, filaments are wound with the use of a wind-up machine via a fifth godet roller 12 and a yarn guide 13.

Poly(trimethylene terephthalate) BCF carpet modified cross-section yarns of the present invention may be produced as a dope dyed yarn according to uses of the carpet. Generally, the dope dyed yarn has excellent stain-resistance and resistance to wear, and can be applied to carpets for use in an office. But, carpets subjected to a piece dyeing can be suitably applied to high quality carpets.

A method for preparing a poly(trimethylene terephthalate) BCF modified cross-section yarn of the present invention as the dope dyed yarn is the same as the method for preparing a poly(trimethylene terephthalate) BCF modified cross-section yarn as described above, except that a color master batch of 2 to 5% based on a base chip is blended with raw materials, and they are spun. The carpet thus produced has more excellent color fastness to washing, color fastness to light, and color fastness to rubbing than the carpet subjected to piece dyeing, and a defective proportion is low because streaking hardly occurs, which is a disadvantage more often seen in carpets subjected to a piece dyeing.

A poly(trimethylene terephthalate) BCF modified cross-section yarn of the present invention may be subjected to steps such as cabling, heat setting, and tufting to produce a carpet.

A poly(trimethylene terephthalate) BCF modified cross-section yarn of the present invention has excellent bulk property and spinning efficiency, and can be applied to produce a cut-pile, a loop-pile, a combination-type carpet, a mat, and a carpet.

EXAMPLE AND COMPARATIVE EXAMPLE

A better understanding of the present invention may be obtained in light of the following examples which are set forth to illustrate, but are not to be construed to limit the present invention.

<Test methods of BCF>

(1) Tenacity

BCF were tested under conditions of a sample length of 20 cm, a stretching velocity of 200 m/mm, a pre-tension of 20 g, and a twist of 8 times/10 cm according to KS K 0412 [method for testing tenacity and elongation of filament yarns].

(2) Crimp

A skein was produced by winding thread on a reel with a diameter of 1 m according to following equation:

$$\text{Winding No.}=(1450d\times18)/BCF\ \text{denier}$$

An initial skein length $L_0$ was measured, and then yarns were left in a drying oven at 130° C. for 5 min, followed by being cooled for 1 min after yarns were removed from the oven. After that, a weight of 50 g was suspended by yarns for 30 min, and then a skein length $L_1$ was measured. Crimp was calculated by substituting the skein lengths $L_0$ and $L_1$ into the following equation.

$$\text{Crimp }\%=(L_0-L_1)/L_0\times100$$

(3) Spinning efficiency

A spinning efficiency was estimated as the number of yarn cutting per a production amount when 3 tons of spun yarn was produced.

(4) Tufting efficiency

A tufting efficiency means a degree of cutting in a pile, and the tufting efficiency was estimated in three grades, i.e. A: good, B: medium, C: bad.

<Test methods of carpet>

(1) Compressibility/Compressive resilience

A ratio of compressibility/compressive resilience was tested according to A of KS K 0818;

(2) Pencil point

Pencil point was estimated in three grades, i.e. A: good, B: medium, C: bad, by observing a degree that the edges of pile was frayed by the naked eye;

(3) Color fastness to light

The carpet was treated at 63° C. for 40 hours, and tested according to KS K 0700. Then, color fastness to light was estimated by use of ISO blue scale;

(4) Color fastness to washing

The carpet was treated at 40° C., and tested according to A-1 of KS K 0430;

(5) Color fastness to rubbing

Color fastness to rubbing was estimated according to KS K 0650; and (6) Streak property Streak property was estimated in three grades, i.e. A: good, B: medium, C: bad, by the naked eye.

Example 1

PTT polymer with a moisture regain of 40 ppm and an intrinsic viscosity of 0.92 was melt-spun at 250° C. with the use of a nozzle having a Y-shaped cross section, 68 holes, a modification ratio of 2.0, and an arm angle of 33° in a barmag spinning machine, which could produce three tons of spun yarns per day, to produce 68 filaments of 1300 deniers. Then, the resulting filaments were cooled to 16° C. in a cooling zone while the filaments had a velocity of 0.5 m/min. After that, the cold filaments were drawn by use of a supplying roller with a temperature of 60° C. and a speed of 700 m/min, and a drawing roller with a temperature of 160° C. and a speed of 2300 m/min.

Drawn yarns were crimped at 200° C. in a bulking unit, cooled down to 16° C. in a cooling drum, and condensed under 4.0 kg/m$^2$ by 20 times/m in a condensing device, and finally wound at 1950 m/min to produce poly(trimethylene terephthalate) BCF modified cross-section yarns.

With the use of a cable twister, the resulting BCF yarns were doubled in a Z twisting manner at 194/m, followed by heat-setting the doubled yarns by a Superba unit. The heat-set yarns were then planted on polypropylene foundation cloth with the use of a tufting machine with a 1/10 gauge. The pile was of a cut pile style with a height of 12 mm, a stitch of 13 inches, and a grey yarn weight of 4 kg/3.3 m$^2$.

The resulting BCF modified cross-section yarns were estimated in terms of a spinning efficiency, crimp, tufting efficiency, and tenacity. The results are described in Table 1.

Examples 2 to 3 and Comparative Examples 1 to 2

The procedure of example 1 was repeated except that a nozzle with a modification ratio and a arm angle described in Table 1 was used. The resulting poly(trimethylene terephthalate) BCF modified cross-section yarns were estimated in terms of spinning efficiency, crimp, and tufting efficiency. The results are described in Table 1.

TABLE 1

| | [1]Mod. | [2]Ang. | Crimp (%) | [3]Yarn cutting (times) | Tuft. Effi. | [4]Ten. |
|---|---|---|---|---|---|---|
| Co. Ex. 1 | 1.3 | 44° | 24 | 22 | C | 2.1 |
| Co. Ex. 2 | 4.0 | 10° | i.m. | i.m. | i.m. | i.m. |
| Ex. 1 | 2.0 | 33° | 57 | 8 | A | 2.1 |
| Ex. 2 | 1.8 | 35° | 48 | 13 | A | 2.1 |
| Ex. 3 | 2.5 | 25° | 54 | 16 | B | 2.0 |

[1]A modification ratio
[2]Arm angle,
[3]Number of yarn cutting
[4]Tenacity
*i.m.: impossible measurement As apparent from the results shown in Table 1, poly (trimethylene terephthalate) BCF modified cross-section yarns according to examples 1, 2, and 3 had excellent bulk property, spinning efficiency, and tufting efficiency, and these were most excellent when a modification ratio is 2.0. On the other hand, modified cross-section yarns of comparative example 1 had a similar tenacity to examples 1, 2, and 3, but lower bulk property and tufting efficiency than that of examples. As for comparative example 2, when the modification ratio was 4.0, a spinning operation could not be performed because yarn cutting continuously occurred. Also, it can be seen that poly(trimethylene terephthalate) BCF modified cross-section yarns of the present invention had excellent tenacity regardless of the modification ratio.

Examples 4 to 5

The procedure of example 1 was repeated except that a nozzle designed in such a way that the modification ratio is 1.5, a ratio of short side length (b) to a long side length (a) of 1:1.4 was used in example 4, and in case of example 5, a nozzle with a length ratio of arms of 1:0.8 was used so that the modification ratio is 3.5 and a friction between the nozzle and a yarn guide is reduced. The resulting poly (trimethylene terephthalate) BCF modified cross-section yarns were estimated in terms of spinning efficiency, crimp, tufting efficiency, and tenacity. The results are described in Table 2.

Comparative Examples 3 to 4

The procedure of example 1 was repeated except that a nozzle was used, in which a modification ratio was the same as that of examples 4 and 5 and a length ratio of arms was 1:1. The poly(trimethylene terephthalate) BCF modified cross-section yarns and a carpet specimen for estimating physical properties were produced, and estimated in spinning efficiency, crimp, tufting efficiency, and tenacity. The results are described in Table 2.

TABLE 2

| | [1]Mod. | b:a | Crimp (%) | [2]Yarn cutting (times) | Tuft. Effi. | [3]Ten. |
|---|---|---|---|---|---|---|
| Co. Ex. 3 | 1.5 | 1:1 | 30 | 20 | B | 2.1 |
| Co. Ex. 4 | 3.5 | 1:1 | i.m. | i.m. | i.m. | i.m. |
| Ex. 4 | 1.5 | 1:0.8 | 50 | 10 | A | 2.1 |
| Ex. 5 | 3.5 | 1:1.4 | 60 | 15 | B | 2.0 |

[1]A modification ratio
[2]Number of yarn cutting
[3]Tenacity
*i.m.: impossible measurement In example 4, a low bulk property, which was a problem of a prior art in case of a low modification ratio, was improved. As for example 5, normal spinning operation was feasible, and so poly(trimethylene terephthalate) BCF modified cross-section yarns with high bulk property and excellent spinning efficiency could be produced. On the other hand, a yarn cutting frequently occurred during the spinning step and modified cross-section yarns had a tufting efficiency of grade B in comparative example 3, and a spinning operation could not be performed because yarn cutting continuously occurred in comparative example 4. As seen in Table 2, poly(trimethylene terephthalate) BCF modified cross-section yarns of the present invention had sufficient tenacity regardless of the modification ratio.

Examples 6 to 7 and Comparative Examples 5 to 6

The procedure of example 1 was repeated except that a nozzle with a modification ratio of 2.0 was used, and a whirling number in a whirling machine was varied as described in Table 3. When the modification ratio was 2.0, BCF modified cross-section yarns were most excellent in crimp, spinning efficiency, tufting efficiency, and tenacity. The resulting poly(trimethylene terephthalate) BCF modified cross-section yarns were tufted in a same manner as other examples.

A tufted carpet was beck-dyed without carriers by use of a disperse dye DIANIX combi under conditions of atmospheric pressure, a dyeing temperature of 98° C., a dispersing agent of 0.5 g/l, OWF (an amount of an added dye based on the carpet) of 0.01%, and a liquid ratio of 20:1.

The dyed carpet was coated with a mixture of base latex of 35%, $CaCO_3$ of 60%, dispersing agent, and viscosity enhancing agent, followed by being adhered to a second foundation cloth, i.e. jute, and finally sheared with the use of a spiral knife. The resulting carpet was estimated in tufting efficiency and pencil point. The results are described in Table 3.

TABLE 3

| | [1]Whirl. (times/min) | [2]Mod. | Tuft. Effi. | [3]Pen. | Note |
|---|---|---|---|---|---|
| Co. Ex. 5 | 8 | 2.0 | C | i.m. | |
| Co. Ex. 6 | 20 | 2.0 | B | C | With bulking |
| Ex. 6 | 20 | 2.0 | A | A | |
| Ex. 7 | 25 | 2.0 | A | B | |

[1]Whirling number
[2]A modification ratio
[3]Pencil point
*i.m.: impossible measurement As best seen in Table 3, carpets produced under conditions of the whirling number of 20 times/min and 25 times/min according to examples 6 and 7, respectively, had excellent tufting efficiency and pencil point. On the other hand, the carpet according to comparative example 5 was produced under a condition of the whirling number of 10 times/min, but not sheared because cutting was not normally accomplished during the tufting. As for comparative example 6, the carpet was produced under a condition of the whirling number of 20 times/min with a bulking step in a bulking unit, and had bad appearance because the edges of pile were excessively frayed.

Example 8 and Comparative Example 7

The procedure of example 1 was repeated except that a color master batch of 3% based on a PTT base chip was supplied to raw materials in order to produce a dope dyed yarn. The resulting poly(trimethylene terephthalate) BCF modified cross-section yarns were tufted to produce a carpet specimen for estimating physical properties. But, the carpet was not separately dyed because the carpet was made from the dope dyed yarn.

A carpet of the comparative example 7 was produced from a grey yarn of the example 1 through procedures of example 4 such as dyeing, backing, and shearing. A dope dyed BCF carpet of example 8 was compared to the carpet of the comparative example 7 in physical properties. The results are described in Table 4.

TABLE 4

| | [1]Compress. (%) | [2]Comp. Resilience (%) | [3]Color fast. | [4]Streak |
|---|---|---|---|---|
| Co. Ex. 7 | 46 | 96 | 4, 4, 5 | A |
| Ex. 8 | 40 | 94 | 5 all | A |

[1]Compressibility
[2]Compressive Resilience
[3]Color fastnesses to washing, light, and rubbing (grades)
[4]Streak property The dope dyed BCF carpet of example 8 had more excellent color fastness to washing, color fastness to light, and color fastness to rubbing than the carpet subjected to piece dyeing, and had slightly better streak property than comparative example 7. But, the grey yarn BCF carpet of example 8 was poor in compressibility and compressive resilience because a dyeing step was absent and a growth of a latent bulk owing to the dyeing step was also absent.

As described above, the present invention provides a poly(trimethylene terephthalate) BCF carpet modified cross-section yarn having uniform physical properties, and excellent bulk property and spinning efficiency.

A carpet made from a poly(trimethylene terephthalate) BCF carpet modified cross-section yarn has excellent elastic recovery, appearance, the sense of touch, and resistance to wear, which are advantages of nylon, as well as good stain-resistance and electrostatic resistance, which are advantages of polyester. The carpet also has excellent post-process efficiency. Accordingly, the poly(trimethylene terephthalate) BCF modified cross-section yarn of the present invention improves a quality of carpets and increases a production efficiency of carpets.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A poly(trimethylene terephthalate) bulked continuous filament carpet yarn with a Y-shaped cross-section, whose modification ratio and arm angle are both within a range of a parallelogram ABCD in FIG. 3.

2. The poly(trimethylene terephthalate) bulked continuous filament carpet yarn according to claim 1, whose length ratio of arms ranges from 1:0.6 to 1:1.8, wherein the length ratio of arms is the ratio of the length of one arm (a) to that of two other identical arms (b) in FIG. 2.

* * * * *